US008074574B2

(12) United States Patent
Riess et al.

(10) Patent No.: US 8,074,574 B2
(45) Date of Patent: Dec. 13, 2011

(54) HARD-CORE PROJECTILE WITH PENETRATOR

(75) Inventors: Heinz Riess, Fürth (DE); Erich Muskat, Roth (DE)

(73) Assignee: Ruag Ammotec GmbH, Furth (DE)

( * ) Notice: Subject to any disclaimer, the term of this patent is extended or adjusted under 35 U.S.C. 154(b) by 17 days.

(21) Appl. No.: 11/572,578

(22) PCT Filed: Jun. 28, 2005

(86) PCT No.: PCT/EP2005/006940

§ 371 (c)(1),
(2), (4) Date: Oct. 3, 2007

(87) PCT Pub. No.: WO2006/010424

PCT Pub. Date: Feb. 2, 2006

(65) Prior Publication Data

US 2008/0035008 A1 Feb. 14, 2008

(30) Foreign Application Priority Data

Jul. 24, 2004 (DE) ..... 10 2004 036 148

(51) Int. Cl.
*F42B 30/02* (2006.01)

(52) U.S. Cl. ..... 102/518

(58) Field of Classification Search ..... 102/514, 102/518, 519, 507, 509, 508
See application file for complete search history.

(56) References Cited

U.S. PATENT DOCUMENTS

| | | | | | |
|---|---|---|---|---|---|
| 36,449 | A * | 9/1862 | Boekel | 102/514 |
| 270,101 | A * | 1/1883 | Nordenfelt | 102/514 |
| 740,914 | A * | 10/1903 | Platz | 102/519 |
| 932,014 | A * | 8/1909 | Haase | 102/519 |
| 1,322,662 | A * | 11/1919 | Watson | 102/510 |
| 1,447,478 | A * | 3/1923 | Koshollek et al. | 102/508 |
| 1,767,308 | A * | 6/1930 | Phillips | 102/507 |
| 2,303,449 | A * | 12/1942 | Fleischmann | 102/514 |
| 2,792,618 | A * | 5/1957 | Walker | 86/55 |
| 3,142,256 | A * | 7/1964 | Mack | 102/514 |
| 3,599,573 | A * | 8/1971 | Sliney | 102/517 |
| 3,756,158 | A * | 9/1973 | Anderson | 102/507 |
| 4,256,039 | A * | 3/1981 | Gilman | 102/519 |
| 4,517,897 | A * | 5/1985 | Kneubuhl | 102/439 |
| 5,160,805 | A * | 11/1992 | Winter | 102/518 |
| 6,186,071 | B1 * | 2/2001 | Fry | 102/515 |
| 6,598,536 | B2 * | 7/2003 | Burri | 102/522 |
| 2008/0196617 | A1 * | 8/2008 | Riess et al. | 102/513 |

* cited by examiner

*Primary Examiner* — Michael Carone

*Assistant Examiner* — Reginald Tillman, Jr.

(74) *Attorney, Agent, or Firm* — Antonelli, Terry, Stout & Kraus, LLP.

(57) ABSTRACT

A penetrator can substantially affect the fragmentation properties of a projectile. As a rule, the penetrator is enclosed by an envelope which combines the projectile core and penetrator in one unit. On hitting the target, a fragmentation of the projectile envelope must first occur which needs energy, influencing the further fragmentation of the projectile and the exit from the target. The invention thus relates to a hard-core projectile (1), with the penetrator (3) provided in a cylindrical drilling (4), in the projectile core (2), running centrally on the projectile axis (5), the length of the penetrator (3) extending over the middle (8) of the projectile, the core (2) enclosing the penetrator (3) in the ogival region (6) to the open tip (16) and the cylindrical part (7) of the core (2), serving as guide in operation, is enclosed by an envelope (9).

23 Claims, 4 Drawing Sheets

HARD-CORE PROJECTILE WITH PENETRATOR

Figure 1:
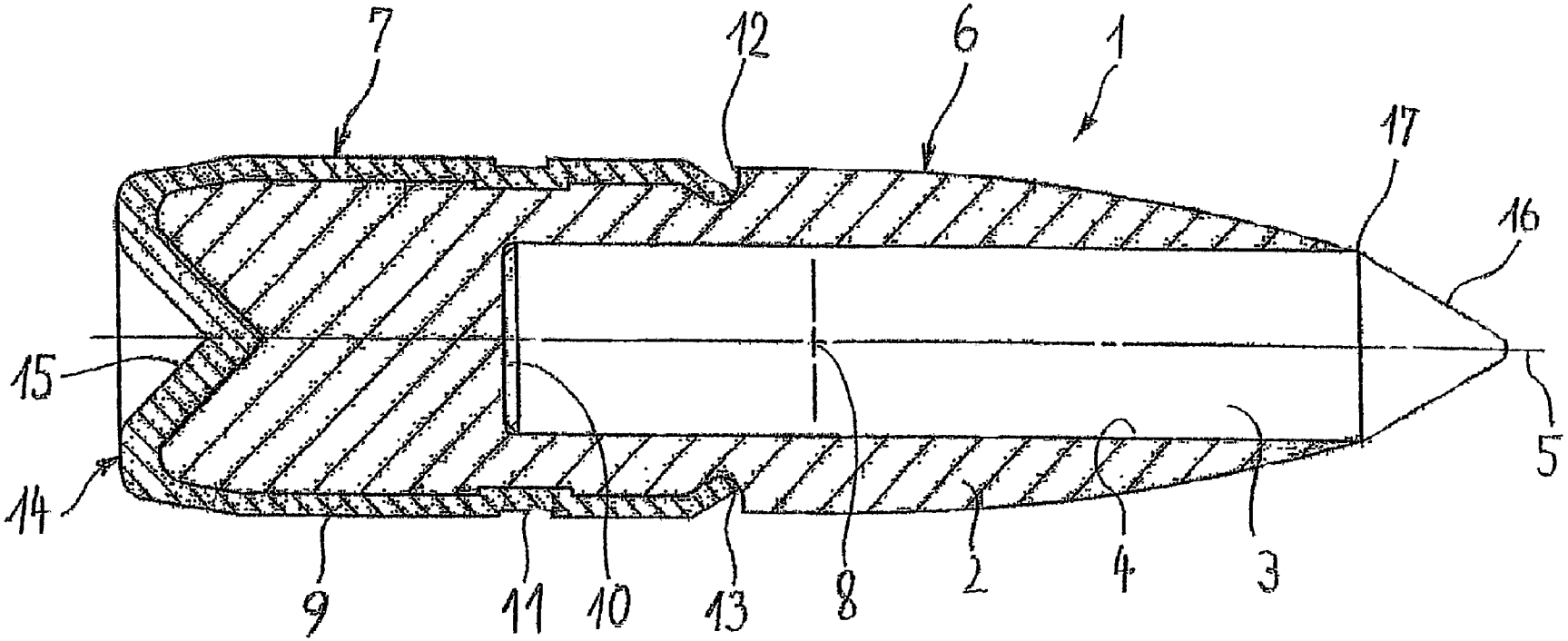

The invention relates to a hard-core projectile comprising a projectile core into which a penetrator is inserted that projects out of the core at the end face.

The object of the invention is to increase the disruptive power, the penetration capacity, of a hard-core projectile.

The object is achieved with the aid of the characterizing features of the first claim. Advantageous constructions of the invention are claimed in the subclaims.

In the hard-core projectile according to the invention, the penetrator is inserted into a cylindrical bore in the projectile core, which bore extends centrically to the projectile axis. The penetrator extends over the centre of the projectile, beyond the ogival region, and into the cylindrical part. The penetrator can fill the bore completely. The projectile core surrounds the penetrator in the ogival part to the exposed head, the wall thickness decreasing continuously to zero. The head of the penetrator is exposed. Only the cylindrical part of the projectile core, which serves for guidance in operation, is surrounded by a jacket.

When the hard-core projectile according to the invention strikes the target body, the penetrator is immediately deployed. For a jacket which surrounds the ogival region, the energy that would be required for deformation and fragmentation of the jacket is fully available to the penetrator in this projectile. The penetrator is made of a material with a very high density, such as tungsten carbide.

Upon further penetration of the projectile into the target body, the projectile core can also deform, depending on the material used. The material of the projectile core consists of a preferably lead-free material which can be used for projectiles, such as hardened or non-hardened steel, or non-ferrous metals such as copper and brass or alloys thereof. With a lead-free material, which places less strain on the environment, the deformation is comparatively lower than with lead, which results in the maximum possible disruptive force.

The penetrator can be fixed in the projectile core in a variety of ways. A force-fitting connection, such as a press fit in which the penetrator is pressed into the core, is simple to produce. However, a material-fitting connection by soldering or adhesion or a form-fitting attachment is also possible. In the latter case, the core material can be pressed for example into one or more grooves in the penetrator. If possible, the type of attachment should ensure that the projectile does not break up into penetrator and projectile core when the projectile penetrates into the target body. The action of the projectile itself and the effects thereof depend on the hardness of the medium in question. With a soft medium, the projectile remains intact. The core and the penetrator do not separate. With a hard medium, the core and penetrator can separate from one another, with the penetrator then forming the scrap.

Figure 2:
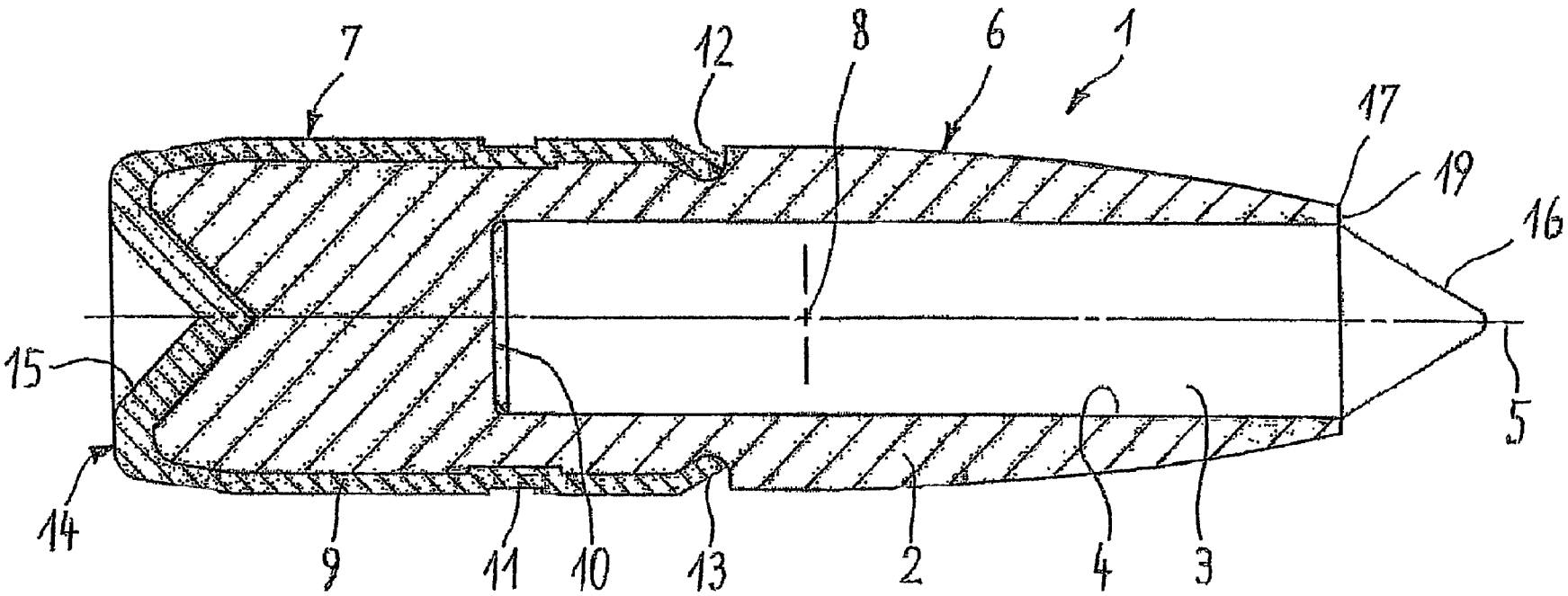
Figure 3:
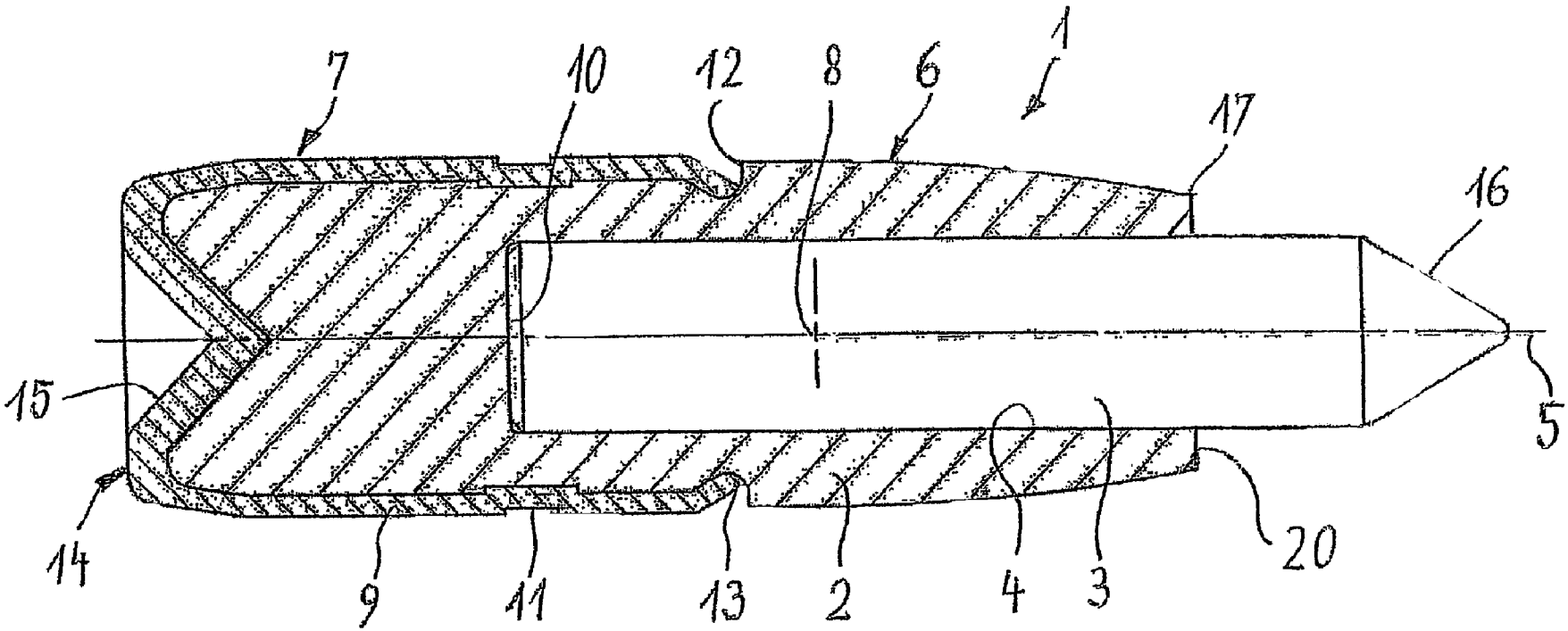
Figure 4:
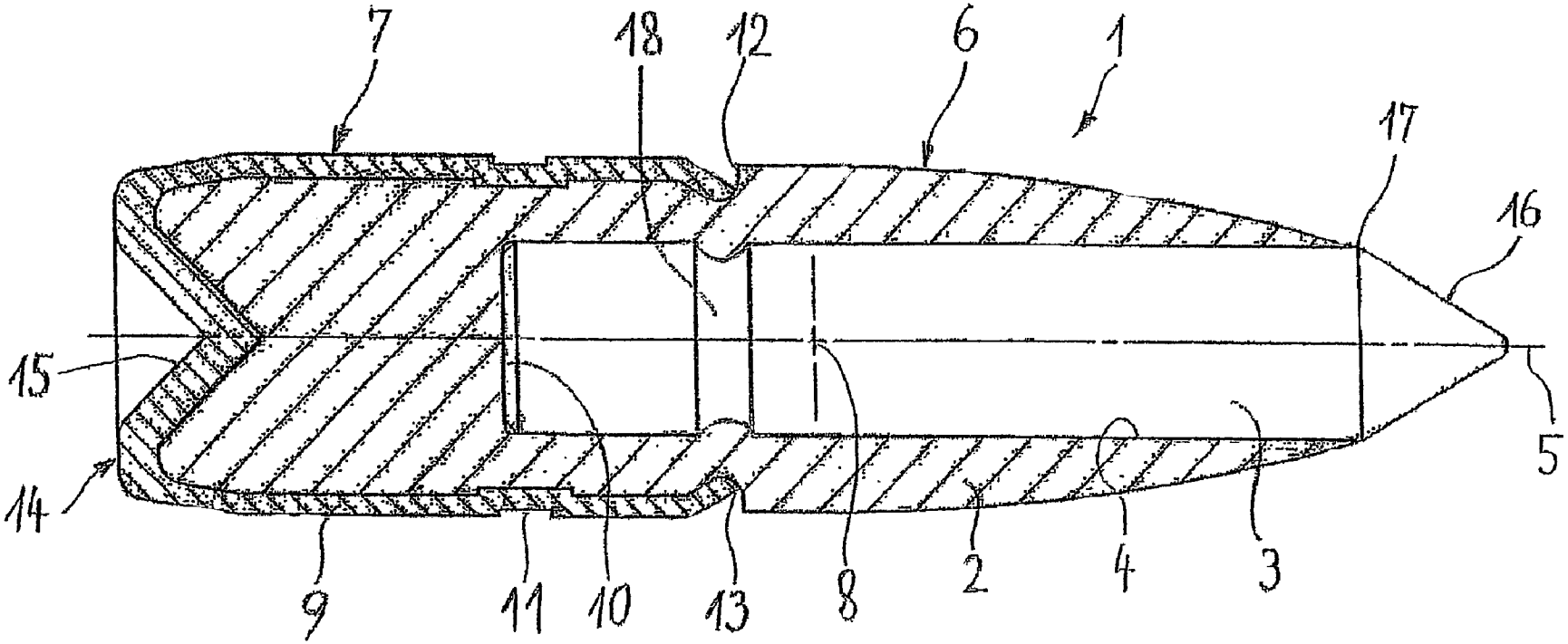

The invention is explained in more detail with reference to exemplary embodiments. The figures show:

FIG. 1 a hard-core projectile in accordance with the invention, with a penetrator which is connected to the projectile core with force fit or material fit;

FIG. 2 a hard-core projectile in accordance with the invention, with a penetrator in which the hard core ends with an annular face at the head of the penetrator;

FIG. 3 a hard-core projectile in accordance with the invention, with a penetrator in which the hard core ends with an annular face in the region of the penetrator; and FIG. 4 a hard-core projectile in accordance with the invention, with a penetrator which is connected to the projectile core with form fit.

In FIG. 1, a hard-core projectile in accordance with the invention is represented in longitudinal section by 1. The projectile core 2 surrounds a penetrator 3 inserted in a cylindrical bore 4 which extends centrically to the projectile axis 5. The penetrator 3 extends beyond the ogival region 6 of the projectile 1 into the cylindrical part 7 which serves for guidance in operation and fills the bore 4 completely in the present embodiment. In the present embodiment, the attachment to the projectile core can be effected with friction fit by press fitting or with a material fit by soldering or adhesion. The ogival region 6 of the projectile, and therefore also the penetrator 3, extend beyond the centre 8 of the projectile.

The cylindrical part 7 of the projectile 1 is surrounded by a jacket 9 which has an indented portion 11 in the region of the base 10 of the bore 4. In the transition from the ogival region 6 to the cylindrical part 7 of the projectile 1, a groove 12, in which the edge 13 of the jacket 9 is pressed so that it does not protrude beyond the surface of the projectile, extends along the circumference of the projectile 1. The projectile jacket is thus prevented from being pulled off when the projectile strikes a target medium. In the tail 14 of the projectile 1, there is a conical depression 15 which improves the flight qualities of the projectile by stabilization.

In the present embodiment, the conical head 16 of the penetrator 3 extends out of the projectile core 2. In this region of the transition 17, the wall thickness of the core 2 tapers to zero.

The inventive hard-core projectile according to FIG. 2 differs from the previous embodiment in the construction of the projectile head. The hard core 2 has, at the transition 17 from the head 16 of the penetrator 3 into the cylindrical part, a narrow annular face 19 extending perpendicularly to the projectile axis 5. This effects a defined detachment of the penetrator upon striking a hard target medium.

The embodiment according to FIG. 3 serves the same purpose. In this projectile, the penetrator 3 has already penetrated into the target medium before the hard core 2 strikes with its annular face 19. In conjunction with the type of attachment of the penetrator 3 in the bore 4, this can influence the separation of the penetrator and the core.

In FIG. 4, a hard-core projectile in accordance with the invention with a form-fitting connection between the penetrator and projectile core is likewise shown in section. All features which correspond to the previous embodiment according to FIG. 1 are denoted by the same reference numerals. The penetrator 3 has, in the transition region from the ogival region 6 of the projectile to the cylindrical part 7, a groove 18 along its circumference. The penetrator 3 is firstly inserted into the bore 4. After pulling over the jacket 9, the jacket and the penetrator 3 are fixed simultaneously in that the edge 13 of the jacket 9 is pressed into the core 2 and therefore the material of the core is pressed into the groove 18. Deviating from the present embodiment, it is also possible to provide further grooves in the penetrator, into which the material of the core can be pressed. This would be feasible instead of an indented portion.

The invention claimed is:

1. A hard-core projectile comprising:

a projectile core having a cylindrical bore in the projectile core, that extends centrically along a projectile axis for less than the entire length of the projectile core, but beyond the centre of the projectile, and that ends with a flat base within the projectile core;

a jacket that surrounds only a substantially cylindrical region of the projectile core;

a penetrator disposed in the cylindrical bore, such that an exposed head of the penetrator projects out of an end face of the cylindrical bore, the length of the penetrator extends along the projectile axis from the exposed head to the flat base end of the cylindrical bore, and the projectile core surrounds most of the penetrator but the projectile core does not surround the exposed head, wherein the penetrator is connected to the projectile core by at least one of a form-fitting connection, a force-fitting connection, and a material-fitting connection.

2. A hard-core projectile according to claim 1, wherein the projectile core comprises a metal, and wherein the projectile core is lead-free.

3. A hard-core projectile according to claim 1, wherein the penetrator comprises tungsten carbide.

4. A hard-core projectile according to claim 1, wherein the penetrator is connected to the projectile core by a force-fitting connection.

5. A hard-core projectile according to claim 1, wherein the penetrator is connected to the projectile core by a material-fitting connection.

6. A hard-core projectile according to claim 1, wherein the material of the projectile core is pressed to form a groove along the outer circumference of the projectile core, the groove being located in a transition region disposed between a substantially ogival region of the projectile core and the substantially cylindrical region of the projectile core; and wherein an edge of the jacket is pressed into the groove along the outer circumference of the projectile core.

7. A hard-core projectile according to claim 1, wherein in the substantially ogival region, the projectile core surrounds the penetrator with a wall thickness decreasing to zero in the direction of the exposed head of the penetrator.

8. A hard-core projectile according to claim 7, wherein the wall thickness of zero occurs at the start of the exposed head of the penetrator.

9. A hard-core projectile according to claim 1, wherein in the substantially ogival region, the projectile core surrounds the penetrator, and wherein the projectile core ends at the end face, in an annular face perpendicular to the projectile axis.

10. A hard-core projectile according to claim 1, wherein the projectile core has an indented portion on its substantially cylindrical region.

11. A hard-core projectile according to claim 1, wherein the tail end of the substantially cylindrical region of the projectile core has a conical depression.

12. A hard-core projectile according to claim 2, wherein the projectile core comprises at least one of hardened steel, non-hardened steel, copper, and brass.

13. A hard-core projectile according to claim 11, wherein the tail end of the jacket has a conical depression.

14. A method for making a hard-core projectile, comprising:

inserting a penetrator into a cylindrical bore of a projectile core, wherein the cylindrical bore extends centrically along a projectile axis for less than the entire length of the projectile core, but beyond the centre of the projectile core, and the cylindrical bore ends with a flat base within the projectile core, the penetrator has an exposed head that protrudes out of an end face of the cylindrical bore, and the length of the penetrator extends from the exposed head to the end of the cylindrical bore with a flat base, the projectile core surrounds most of the penetrator but the projectile core does not surround the exposed head of the penetrator, wherein the projectile core is connected to the penetrator by at least one of a form-fitting connection, a force-fitting connection, and a material-fitting connection; and surrounding, by a jacket, a substantially cylindrical region of the projectile core.

15. A method for making a hard-core projectile according to claim 14, further comprising:

pressing the material of the projectile core to form a groove along the outer circumference of the projectile core and perpendicular to the length of the cylindrical bore, the groove being located in a transition region disposed between a substantially ogival region of the projectile core and the substantially cylindrical region of the projectile core;

pressing an edge of the jacket into the groove along the outer circumference of the projectile core.

16. A hard-core projectile, comprising:

a projectile core, including a cylindrical bore that extends centrically along a projectile axis for less than the entire length of the projectile core but beyond the centre of the projectile core, wherein the bore ends with a flat base within the projectile core and the bore has an opening at an end face of the projectile core, and a penetrator disposed in the cylindrical bore, such that an exposed head of the penetrator protrudes out of an end face of the cylindrical bore, the penetrator is mostly surrounded by the projectile core but the projectile core does not surround the exposed head of the penetrator, the length of the penetrator extends from the exposed head to the flat base of the cylindrical bore, wherein the penetrator is connected to the projectile core by at least one of a form-fitting connection, a force-fitting connection, and a material-fitting connection; and a jacket that surrounds only a substantially cylindrical region of the projectile core.

17. A hard-core projectile according to claim 1, wherein the penetrator is connected to the projectile core by a form-fitting connection, such that the material of the projectile core is pressed into a groove along the outer circumference of the penetrator, the groove of the penetrator being positioned in the transition region of the projectile core disposed between a substantially ogival region of the projectile core and the substantially cylindrical region of the projectile core.

18. A method for making a hard-core projectile according to claim 14, wherein the penetrator is connected to the projectile core by a form-fitting connection, such that the material of the projectile core is pressed into a groove along the outer circumference of the penetrator, the groove of the penetrator being positioned in the transition region of the projectile core disposed between a substantially ogival region of the projectile core and the substantially cylindrical region of the projectile core.

19. A hard-core projectile according to claim 16, wherein the penetrator is connected to the projectile core by a form-fitting connection, such that the material of the projectile core is pressed into a groove along the outer circumference of the penetrator, the groove of the penetrator being positioned in the transition region of the projectile core disposed between a substantially ogival region of the projectile core and the substantially cylindrical region of the projectile core.

20. A hard-core projectile according to claim 19, wherein the material of the projectile core is pressed to form a groove along the outer circumference of the projectile core, in the transition region; and wherein an edge of the jacket is pressed into the groove along the outer circumference of the projectile core.

21. A hard-core projectile according to claim 1, wherein the projectile core also does not surround an additional segment of the penetrator.

22. A method for making a hard-core projectile according to claim 14, wherein the projectile core also does not surround an additional segment of the penetrator.

23. A hard-core projectile according to claim 16, wherein the projectile core also does not surround an additional segment of the penetrator.

* * * * *